United States Patent [19]

Smith

[11] 4,268,193

[45] May 19, 1981

[54] MINE ROOF SUPPORTS

[75] Inventor: John C. Smith, Wakefield, England

[73] Assignee: Fletcher Sutcliffe Wild Limited, Great Britain

[21] Appl. No.: 99,009

[22] Filed: Nov. 29, 1979

[51] Int. Cl.[3] ..... E21D 15/44

[52] U.S. Cl. ..... 405/292; 405/296

[58] Field of Search ..... 405/291, 292, 300, 299, 405/296, 301; 248/357; 299/31-33; 91/170 MP

[56] References Cited

U.S. PATENT DOCUMENTS

| | | | |
|---|---|---|---|
| 3,115,754 | 12/1963 | Joseph | 405/299 X |
| 3,324,664 | 6/1967 | Allen | 405/292 |
| 3,357,742 | 12/1967 | Dommann et al. | 405/299 X |
| 3,383,866 | 5/1968 | Groetschel | 405/301 |
| 4,012,914 | 3/1977 | Wehner | 248/357 X |
| 4,030,308 | 6/1977 | Dudley et al. | 248/357 X |
| 4,037,419 | 7/1977 | Hill et al. | 248/357 X |

*Primary Examiner*—Stephen J. Novosad

*Attorney, Agent, or Firm*—Lowe, King, Price & Becker

[57] ABSTRACT

A mine roof support comprises a plurality of hydraulically extensible chock legs 5,6, articulated at upper ends thereof to one or more roof beams 3 and at lower ends thereof to one or more base members 1, a shield 9 pivotally connected to a rearward part of the base member 1 and also pivotally connected to a rearward part of the roof beam 3, with permanently pressurized rams 12 both located between a pair of laterally spaced chock legs 6 and one located to each side of the center line 19 of the support, the rams being mutually inclined with respect to the center line 19 and reacting via the shield 9 on the roof beam 3, and a pair of tie bars 11 located one at or towards each side of the support and both connected between the roof beam 3 and the shield 9.

7 Claims, 4 Drawing Figures

MINE ROOF SUPPORTS

This invention relates to a mine roof support of the type of support incorporating a plurality of hydraulically extensible chock legs articulated at upper ends thereof to one or more roof bars, and at lower ends thereof to one or more base members.

Such supports are commonly used in the longwall mining of minerals, notably coal, by being spaced along a mineral face, with an armoured conveyor interposed between the supports and the face, the supports being connected to the conveyor to advance the individual pans thereof towards the newly exposed mineral face, after passage of the mineral winning device, with the supports in their roof supporting condition. Conversely, when it is required to advance the supports towards the advanced conveyor, the chock legs are retracted and the supports pulled forward by reacting on the conveyor.

In practice, however, there is relative movement between the mine roof and the mine floor, while there also exists the possibility of the roof beam(s) striking a roof projection, while the support is being advanced. Both these effects result in the upper ends of the chock legs being displaced. The displacement is usually rearwardly or a combination of rearward and lateral displacement, but forward displacement is not unknown in certain conditions. To avoid damage to the chock legs by this displacement, several proposals have been put forward aimed not only at accommodating a few degrees of displacement, but also serving to restore the chock legs to a pre-determined position, upon release of the support from the roof. However, such restoration proposals have all incorporated a restoration device reacting between the base member(s) of the support and at least one chock leg thereof. This of necessity results in the introduction of bending loads and stresses into the chock leg(s).

In our U.K. Application Ser. No. 17442/77 (=U.S. Pat. No. 4,139,326) is described a mine roof support wherein the transmission of restoration forces via the chock legs is avoided, the invention employing permanently loaded force supplying means operable through a shield of the support. If only linear displacement forces (i.e. those operable along the centre line of the roof support) were encountered in practice then the location of force applying means, e.g. rams, with lines of action parallel to the centre line would be satisfactory. However, non-linear forces are commonly encountered and a proposal described in our U.K. Application Ser. No. 17442/77 (=U.S. Pat. No. 4,139,326) to deal with this is to employ two spaced apart rams located on opposite sides of the center line of the support and inclined with respect to such centre line. For optimum effectiveness, it is desirable for these rams to be spaced as far apart as possible, i.e. one adjacent each lateral side of the support which implies, in a four leg support, that the rams are outside the legs. However, in certain circumstances, it is not possible to locate the rams in this optimum position and accordingly they must be located between the legs, thereby reducing their effectiveness in firstly resisting displacement forces and secondly in restoring a displaced roof bar(s), and it is to this form of roof support that the present invention is directed.

According to the present invention, a mine roof support comprises a plurality of hydraulically extensible chock legs articulated at upper ends thereof to one or more roof beams and at lower ends thereof to one or more base members, a shield pivotally connected to a rearward part of the base member(s) and also pivotally connected to a rearward part of the roof beam(s), with permanently pressurised rams, both located between a pair of laterally spaced chock legs and one located to each side of the centre line of the support, the rams being mutually inclined with respect to such center line and reacting via the shield on the roof beam(s) in such a manner that the rams resist displacement of the roof beam(s) and, upon retraction of the chock legs from the mine roof, restore displaced chock legs to a predetermined position, and a pair of tie bars located one at or towards each side of the support and both connected between the roof beam(s) and the shield, the tie bars readily allowing mutual convergence of the roof beam(s) and shield, and also determining the length of effectiveness of the rams and hence the maximum separation between the roof beam(s) and shield at each side of the support.

Thus, with the support according to the present invention, the tie bars ensure the presence of greater turning moments to resist lateral or twisting forces on the roof beam(s) and subsequently to restore the roof beam(s) to a predetermined location at the last increment of restoration, such as when a first ram is nearly extended and the second is not so extended. Thus the second ram employs the fulcrum provided by the tie bar remote from that ram.

Preferably, the shield is pivotally connected via a link mechanism to the base member. The link mechanism may comprise two links, one above the other, and preferably located at each side of the support within the overall width of the support.

Each tie bar may be constituted by a bolt, the bolt head being located in a slot, e.g. provided in a bracket carried by the shield, while the threaded bolt stem may pass through an aperture in a bracket carried by the roof bar, with a nut applied to the threaded bolt stem. The use of washers at the threaded end enables the effective lengths of the bolts to be readily adjusted to predetermine the leg angle.

The rams are preferably suspended from the roof beam(s) and react on an upper portion of the shield. In detail, the piston rod of each ram may be pivotally attached to the roof beam e.g. via a pin carried by a bracket attached to the roof beam, while the cylinder of each ram may be similarly attached to the shield.

Conveniently, the rams are provided with a check valve for admission of fluid and with a relief valve to yield when a predetermined pressure is attained. Preferably, in an initial, predetermined and non-displaced condition, the piston rod of each ram is fully extended so that should rearward roof beam displacement for instance occur, the cylinder of each ram remains stationary while the piston of each ram slides into its cylinder, and annulus volume being enlarged. The maximum allowable chock leg inclination occurs when the rams have been fully retracted. When the roof support is released, either fully or partially from the roof, readmission of pressure fluid to the full bore sides of the rams, to replace that exhausted during roof beam displacement, causes the rams to react on the shield to restore the roof beam(s) to the predetermined position. Such readmission may be automatically effected by permanently connecting the full bore sides of the rams to the hydraulic mains supplying the chock legs, while the tie bars increase the effectiveness of the rams towards the end of their restoration movements.

Preferably, the two rams are so inclined that their forward ends are adjacent one another and their rearward ends are remote from one another. This enables lateral displacement to be countered and/or restored.

One may readily reverse the mode of operation of the restoration rams if forward roof movement is encountered, by permanently pressurising the annulus side of the rams. Thus for univeral use, the rams may be made double-acting.

The shield may be generally channel shaped, adapted, in the retracted condition of the roof support, to telescope over a built up rear base portion of the support which portion becomes increasingly exposed as the shield is lifted until the roof beam(s) engages the mine roof.

The invention will now be further described by way of example, with reference to the accompanying drawings, in which.

Figure 1:
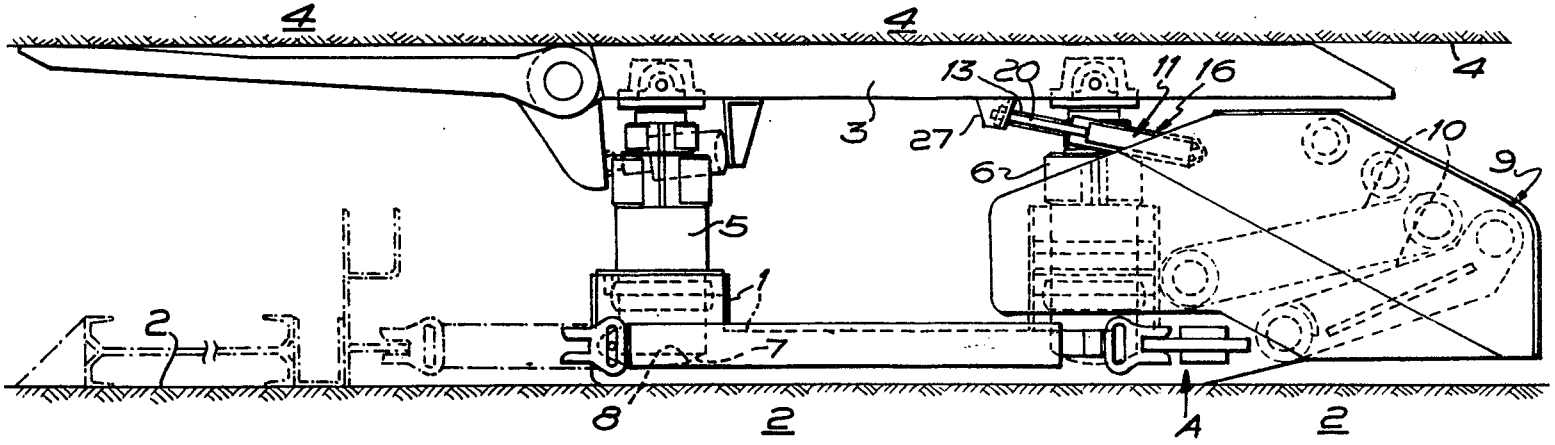
FIG. 1 is a side elevation of a four leg, hydraulically powered, self-advancing mine roof support in accordance with the invention.

In FIG. 1, the mine roof support can be seen to comprise a base member 1 seated on a mine floor 2 with a roof beam 3 in engagement with a mine roof 4, the base member 1 and roof beam 3 being spaced apart by two forwardly located, hydraulically extensible chock legs 5 and two similar rearwardly located chock legs 6. Each chock leg is articulated to both the base member 1 and the roof beam 3 at known joints incorporating arcuate bearing surfaces 7 and 8. A shield 9 is pivotally connected to a rearward part of the base member 1 by being mounted at each side on pairs of upper and lower links 10, while the shield is also pivotally attached to a rearward part of the roof beam 3, by means of tie bars 11 and permanently pressurised rams 12.

Figure 2:
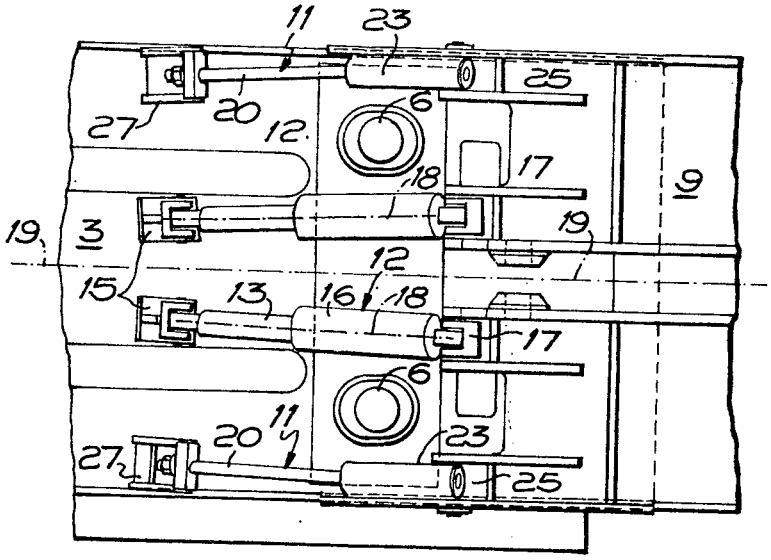
FIG. 2 is a view in the direction of arrow A of FIG. 1 on the underside of the roof beam.
Figure 3:
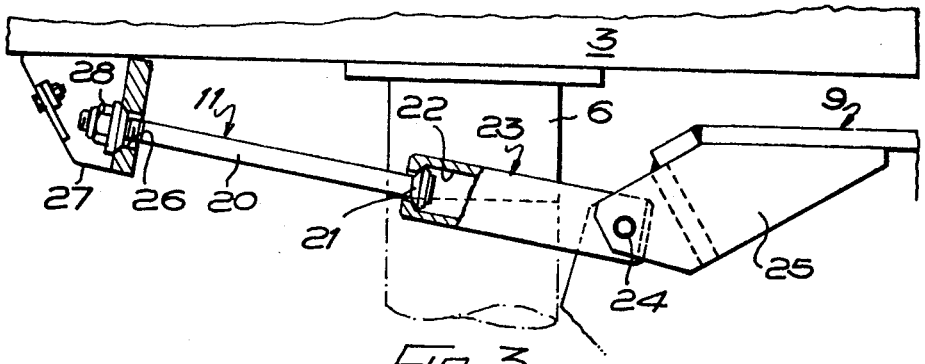
FIG. 3 is an enlarged view, partly in section, of a tie bar of FIGS. 1 and 2.
Figure 4:
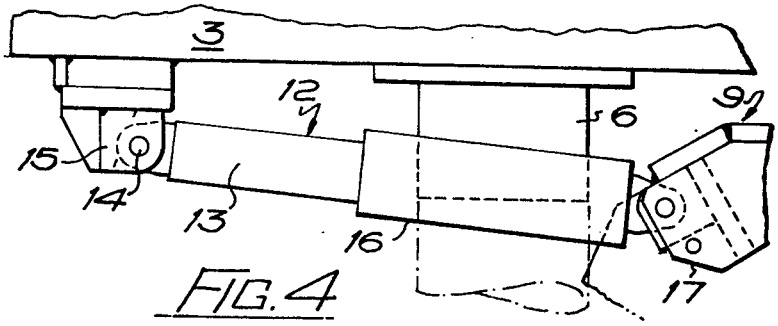
FIG. 4 is an enlarged view of a ram of FIGS. 1 and 2.

Each ram 12 comprises a piston rod 13 pivotally secured at 14 to a bracket 15 depending from the underside of the roof beam 3, while the full bore cavity of a cylinder 16 is permanently pressurised with hydraulic fluid so that piston 13 is normally urged to the extended position shown, the cylinder 16 being pivotally attached to a bracket 17 of the shield 9. As shown in FIG. 2, each ram 12 is located along an axis 18 inclined with respect to the center line 19 of the roof support.

Each tie bar 11 comprises a bolt 20 having at one end a bolt head 21 located in a slot 22 of a tube 23 pivotally attached at 24 to a bracket 25 of the shield 9. At its other end the bolt 20 terminates in a threaded stem passing through an aperture 26 in a bracket 27 carried by the roof bar 3, a nut 28 being applied to the threaded stem to secure that bolt end to the bracket 27.

In the drawings, the roof support is shown in a non-displaced condition. If and when rearward displacement of the upper end of the chock legs 5, 6 occurs e.g. by natural rearward movement of the roof 4, or during advance of the roof support towards a mineral face, the cylinders 16 remain stationary, or substantially so, due to the non-movement of the shield 9, while the piston rods 13, being carried by the roof beam 3, are displaced into the respective cylinders 16.

What I claim is:

1. A mine roof support comprising at least one roof beam and at least one base member, a plurality of hydraulically extensible chock legs articulated at upper ends thereof to said roof beam and at lower ends to said base member, a shield pivotally connected to a rearward part of said base member and also pivotally connected to a rearward part of said roof beam, permanently pressurised rams, both located between a pair of said chock legs which are laterally spaced and one located to each side of the center line of said support, said rams being mutually inclined with respect to said center line and reacting via said shield on said roof beam in such a manner that said rams resist displacement of said roof beam and, upon retraction of said chock legs from a mine roof, restore displaced chock legs to a predetermined position, and a pair of tie bars located one towards each side of said support and both connected between said roof beam and said shield, said tie bars readily allowing mutual convergence of said roof beam and said shield, and also determining the length of effectiveness of said rams and hence maximum allowable separation between said roof beam and said shield at each side of said support.

2. A mine roof support as claimed in claim 1, wherein said shield is pivotally connected via a link mechanism to said base member.

3. A mine roof support as claimed in claim 2, wherein said link mechanism comprises two links, one above the other.

4. A mine roof support as claimed in claim 1, wherein said tie bars are each constituted by a bolt, a head of said bolt being located in a slot while a threaded stem of said bolt passes through an aperture in a bracket carried by said roof beam, with a nut applied to said threaded bolt stem.

5. A mine roof support as claimed in claim 4, wherein said slot is provided in a bracket carried by said shield.

6. A mine roof support as claimed in claim 1, wherein said rams are suspended from said roof beam and react on an upper portion of said shield.

7. A mine roof support as claimed in claim 1, wherein said two rams are mutually inclined so that their forward ends are adjacent one another and their rearward ends are remote from one another.

* * * * *